US006902161B2

(12) United States Patent
Gordon et al.

(10) Patent No.: US 6,902,161 B2
(45) Date of Patent: Jun. 7, 2005

(54) SHEET FEEDER AVOIDING SHEET SAG

(75) Inventors: Michael Kurt Gordon, Round Rock, TX (US); Thomas Campbell Wade, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 27 days.

(21) Appl. No.: 10/405,985

(22) Filed: Apr. 2, 2003

(65) Prior Publication Data

US 2004/0195755 A1 Oct. 7, 2004

(51) Int. Cl.[7] ..... B65H 1/00
(52) U.S. Cl. ..... 271/161; 271/9.09; 271/238
(58) Field of Search ..... 271/161, 9.09, 271/264, 238, 171; 347/104

(56) References Cited

U.S. PATENT DOCUMENTS 4,669,721 A * 6/1987 Westover ..... 271/272
4,848,762 A * 7/1989 Beery ..... 271/19
5,419,548 A * 5/1995 Ueda et al. ..... 271/294
5,454,648 A * 10/1995 Lee ..... 400/48
5,476,255 A * 12/1995 Murcko et al. ..... 271/109
5,563,698 A * 10/1996 Okada ..... 399/381
5,603,493 A * 2/1997 Kelly ..... 271/188
5,685,533 A * 11/1997 Hartsoe ..... 271/11
5,887,239 A * 3/1999 Hong et al. ..... 399/405
5,927,702 A * 7/1999 Ishii et al. ..... 271/9.09
6,065,747 A * 5/2000 Khovaylo et al. ..... 271/209
6,181,908 B1 1/2001 Leemhuis et al.
6,231,043 B1 * 5/2001 James et al. ..... 271/209

FOREIGN PATENT DOCUMENTS

JP 06191649 A * 7/1994 ..... B65H/1/02
WO WO 8802735 A * 4/1988 ..... B65H/1/06

* cited by examiner

*Primary Examiner*—Donald P. Walsh
*Assistant Examiner*—Matthew J. Kohner
(74) *Attorney, Agent, or Firm*—John A. Brady; Frederick H. Gribbell

(57) ABSTRACT

An entrance guide for externally fed sheet (4) to printer (1) is configured to bow the sheets. In one embodiment guides (5*a*, 5*aa*) within slot 7 have upper and lower configurations which force sheet into a bow. In one embodiment slot (7*a*) is bowed and is sufficiently narrow in height to only accept a bowed sheet. The bowed sheets do not sag against the printer (1), which aids in sheet registration.

17 Claims, 5 Drawing Sheets

SHEET FEEDER AVOIDING SHEET SAG

TECHNICAL FIELD

This invention is to feeding sheets in a manner, which causes the sheets to be accurately received in transport mechanism so as to be properly positioned for imaging. Typically the sheets are intended to be manually inserted in the imaging device.

BACKGROUND OF THE INVENTION

In imaging devices, such as printers, feeding sheets individually from external of the imaging device allows selection of individual sheets having unique characteristics, such as letterhead or preprinted borders, or selected width. It is common to either simply provide a slot leading to the sheet transport mechanism of the device or to provide an external tray on which the sheet is slid across so as to be more reliably positioned in the sheet transport.

Reliably positioning the sheet is important because, if the sheet sags against the imaging device structure, the sheet may not feed evenly. When the sheet sags against the device an uneven frictional drag can occur and the sheet enters the sheet feed mechanism turned from the intended position. Accurate registration of the sheet is then lost and not normally recovered, and the final image is turned from the correct position. In extreme cases the sheet jams within the printer.

In those devices in which no guide structure is provided, entire reliance is on the careful insertion of the sheet by the operator. Experience indicates that defective insertions will occur fairly frequently, especially with new operators.

Those devices that have a guide tray are generally effective in achieving proper insertion of the sheets. However, such guide surfaces necessarily extend from the side of the imaging device during use. To avoid such extension being permanent and thereby always defining a perimeter of the imaging device, the guide trays are generally thin structures, which slide into or out of the imaging device or fold out from the device or otherwise need to be positioned by the operator. Such operator intervention reduces productivity and requires some training of the operator. The tray structures themselves add cost to the imaging device, and, since they are thin and relatively unprotected, they are subject to damage.

DISCLOSURE OF THE INVENTION

This invention provides a sheet guide at or near the wall of the imaging device that causes the sheet to bend along the direction of insertion and therefore not sag. Operation is intuitive because pertinent structures are at or near the opening into which the operator necessarily must insert the sheet. Guide structures may be at each end of an entrance opening, with the opposing guide structures each having lower surfaces higher than the center of the opening and upper surfaces sloped downward to reach at least somewhat below the upper level of the lower surfaces. A wide variety of alternative structures configured to force the sheet to bend, and it is the bending which provides beam strength so that the sheet does not sag against the image device. One alternative is an entrance slot in the form of an arc with the low point in the center and of limited height so as to only accept a bowed sheet.

It is widely understood in the paper feed and imaging art that a bent paper or other such sheet has increased beam strength perpendicular to the line of the bend. Only a single bend is necessary in accordance with this invention, but structures that provide multiple, parallel bends would similarly prevent sag and function in accordance with this invention.

BRIEF DESCRIPTION OF THE DRAWINGS

The details of this invention will be described in connection with the accompanying drawings, in which.

DESCRIPTION OF THE PREFERRED EMBODIMENTS

Figure 1:
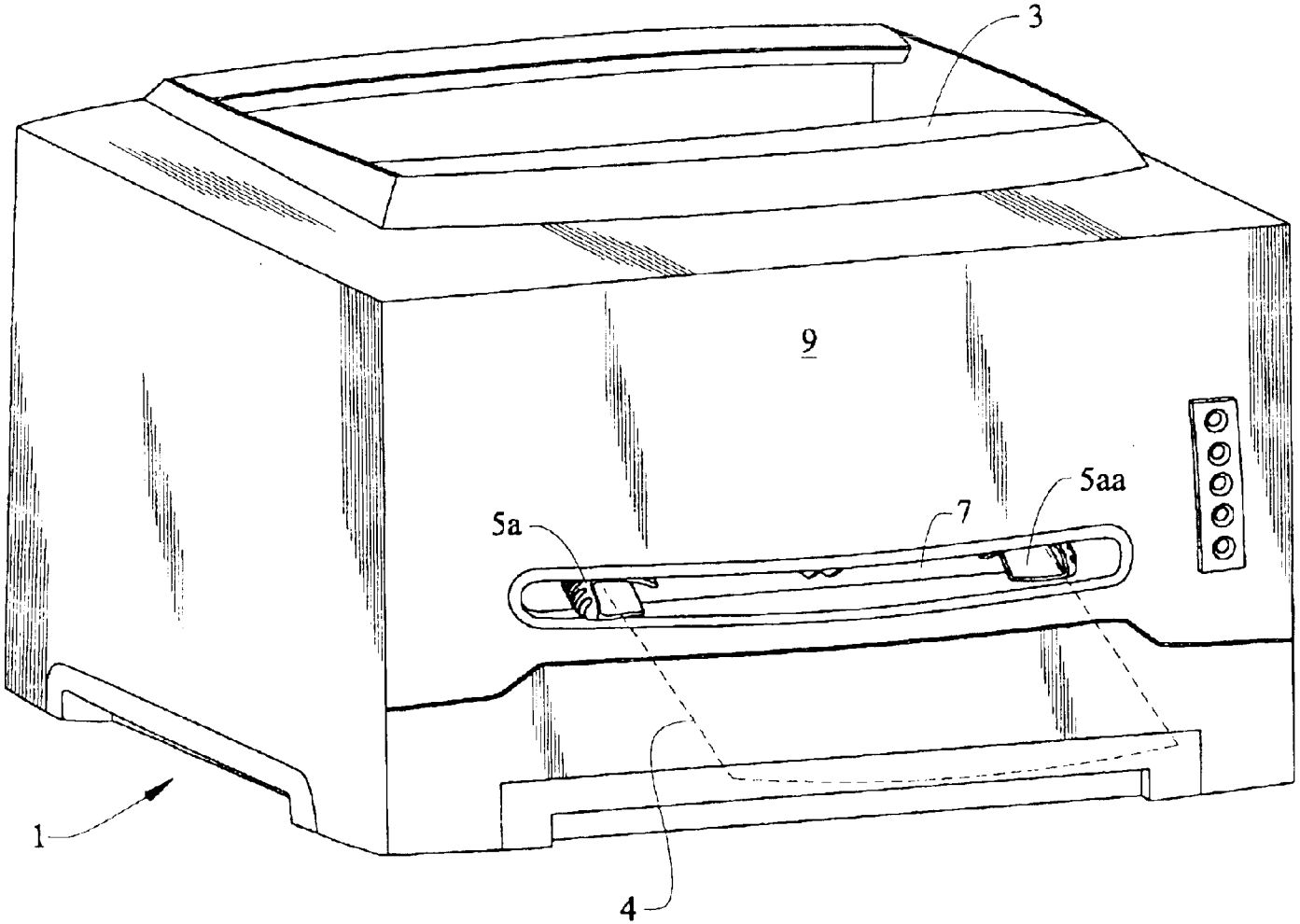
FIG. 1 is illustrative of a printer having a manual entry sheet feed in accordance with this invention.

The printer 1 in FIG. 1 is shown without details as it is intended to be illustrative since this invention would be operable with virtually any imaging device. The imaging engine of printer 1 (internal and not shown) might be a conventional xerographic system. Printer 1 has an internal paper tray to supply paper from a stack of paper without manual intervention except to refill the tray. The imaged paper or other sheet is exited onto the top surface or tray 3 of printer 1. A sheet of paper 4 inserted in accordance with this invention is shown, in dotted outline for overall clarity of FIG. 1.

The paper 4 has a bowed configuration along the direction of entry, which is required by the left, and right guide structures, 5*a* and 5*aa* respectively. The center of paper 4 is at or near the bottom of slot 7, while the configuration of guide structures 5*a* and 5*aa* lift the left and right sides of paper 4 above the bottom of slot 7.

Figure 2:
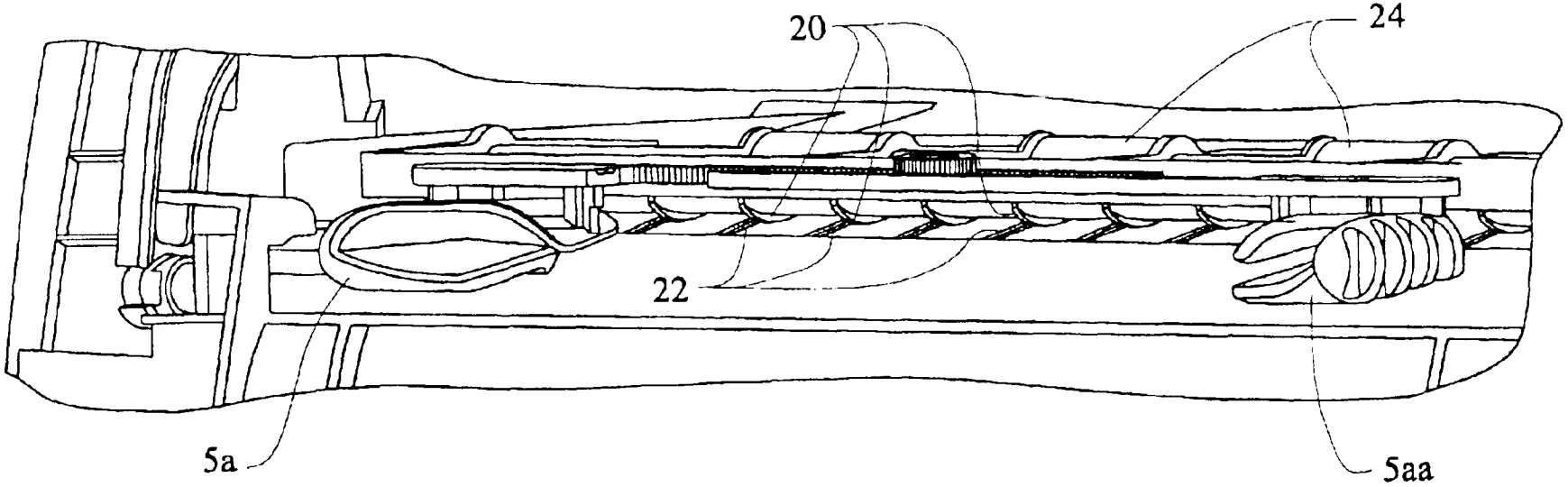
FIG. 2 is a partial view from a right perspective of the printer of FIG. 1 with parts omitted to show the opposing guide structures in relations to the sheet feed mechanism into which a sheet is fed.

Slot 7 is an opening in the front side 9 of printer 1 which is directly opposite sheet feed mechanism of printer 1, shown in FIG. 2 with respect to this embodiment. Stationary upper guide ribs 20 receive paper from slot 7 and direct it against lower guide ribs 22. The paper 4 is then in the proper position to enter a nip between upper feed rollers 24 and lower feed rollers (not shown). Such sheet feed mechanism is essentially entirely conventional and therefore will not be discussed in further detail. FIG. 2 also shows the guide structures 5*a* and 5*aa*, thereby showing the spacing relationship between the sheet feed mechanisms and the guides structures 5*a* and 5*aa*.

Figure 3:
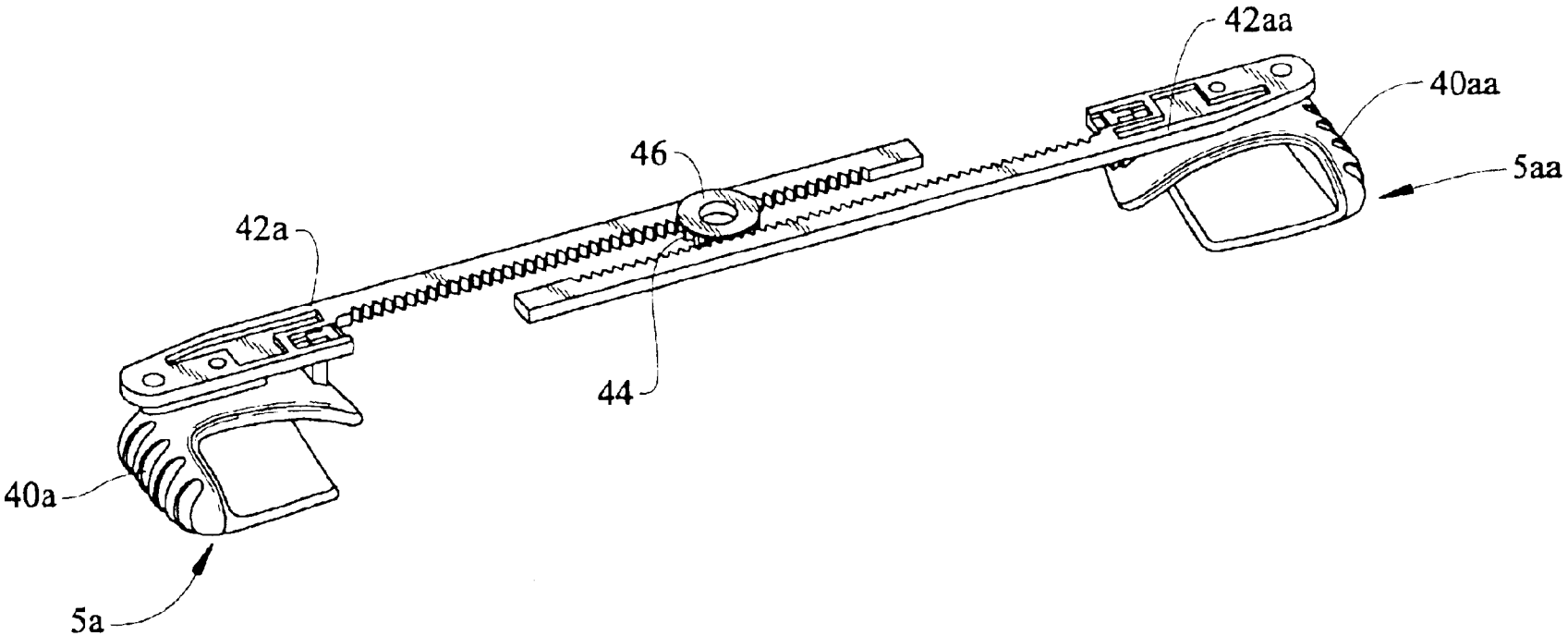
FIG. 3 illustrates the opposing sheet guides as mounted for lateral movement.

The guide structures 5*a* and 5*aa* are shown just with their mounting elements in FIG. 3. The guide structures 5*a* and 5*aa* are mirror images of each other. The ribbed, outer sides 40*a* and 40*aa* respectively are handles for grasping by the operator. Guide structure 5*a* is fixedly mounted to an upper supporting plate 42*a*, which has a toothed rack extending toward guide structure 5*aa*. Similarly, guide structure 5*aa* if fixedly mounted to upper supporting plate 42*aa*, which has a toothed rack extending toward guide structure 5*a*. The teeth of structures 5*a* and 5*aa* face each other, and engage mating teeth of wheel 44 (shown only in small part) which depends from drag ring 46. This combination provides a structure in which the two guide structures 5*a*, 5*aa* can be moved different widths manually, by pushing one or both of the guide structures 5*a*, 5*aa* while remaining centered in slot 7. Friction from drag ring 46 then holds guide structures 5*a*, 5*aa* in place until they are again manually moved with force to overcome that friction. The guide structures 5*a*, 5*aa* are thereby positioned to receive paper 4 of other sheets of different widths.

Figure 4:
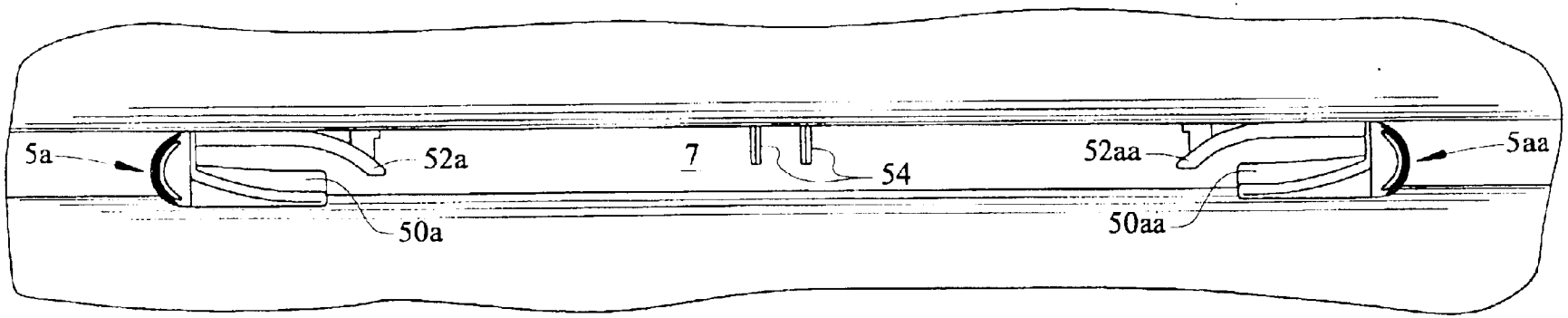
FIG. 4 is a front view showing the opposing sheet guides in relation to the entry slot in which they are located.

The front view of FIG. 4 best illustrates the forcing action of guide structures 5*a* and 5*aa*. The bottom surface of each structure 5*a*, 5*aa* is an upward sloping section 50*a*, 50*aa*, sections 50*a*, 50*aa* being lower at the front of the printer 1 and higher on the side more internal to printer 1. The upper surface 52*a*, 52*aa* are downward sloping. Each structure 52*a*, 52*aa* respectively terminates downward at a location as shown, which is below the final height of the sections 50*a*, 50*aa*. Depending stationary blocking elements 54 located in near the center of slot 7 terminate at a location substantially equal in height to the final height of the sections 50*a*, 50*aa*. Blocking elements 54 are visually apparent and thereby further discourage incorrect insertion of paper 4 by at least appearing to block paper 4 from passing through slot 7 while horizontal.

An operator beginning to insert paper in slot 7 necessarily observes that the paper 4 must be bent downward in the middle, as the paper 4 would be blocked in other configurations. This is also a natural way to grasp paper. When the paper 4 is inserted, it is under surfaces 52*a*, 52*b*, and, as it is moved by the operator into printer 1, it encounters upward sloping sections 50*a*, 50*aa*, and thereby is forced into a bowed configuration.

With paper 4 in such a bowed configuration, it will not sag against the body of printer 1 and therefore will be accurately received by feed rollers 24. This assures that paper will not drag against the front surface of printer 1 when being fed. Elimination of such drag is a necessary component of ensuing good registration. However, other factors as the media enters, such as the user loading the paper 4 or other sheet perpendicular to the feed rollers 24 and the mechanical accuracy of the feed mechanism of printer 1 or other imaging device as the media enters, are also important to accurate sheet registration.

Figure 5:
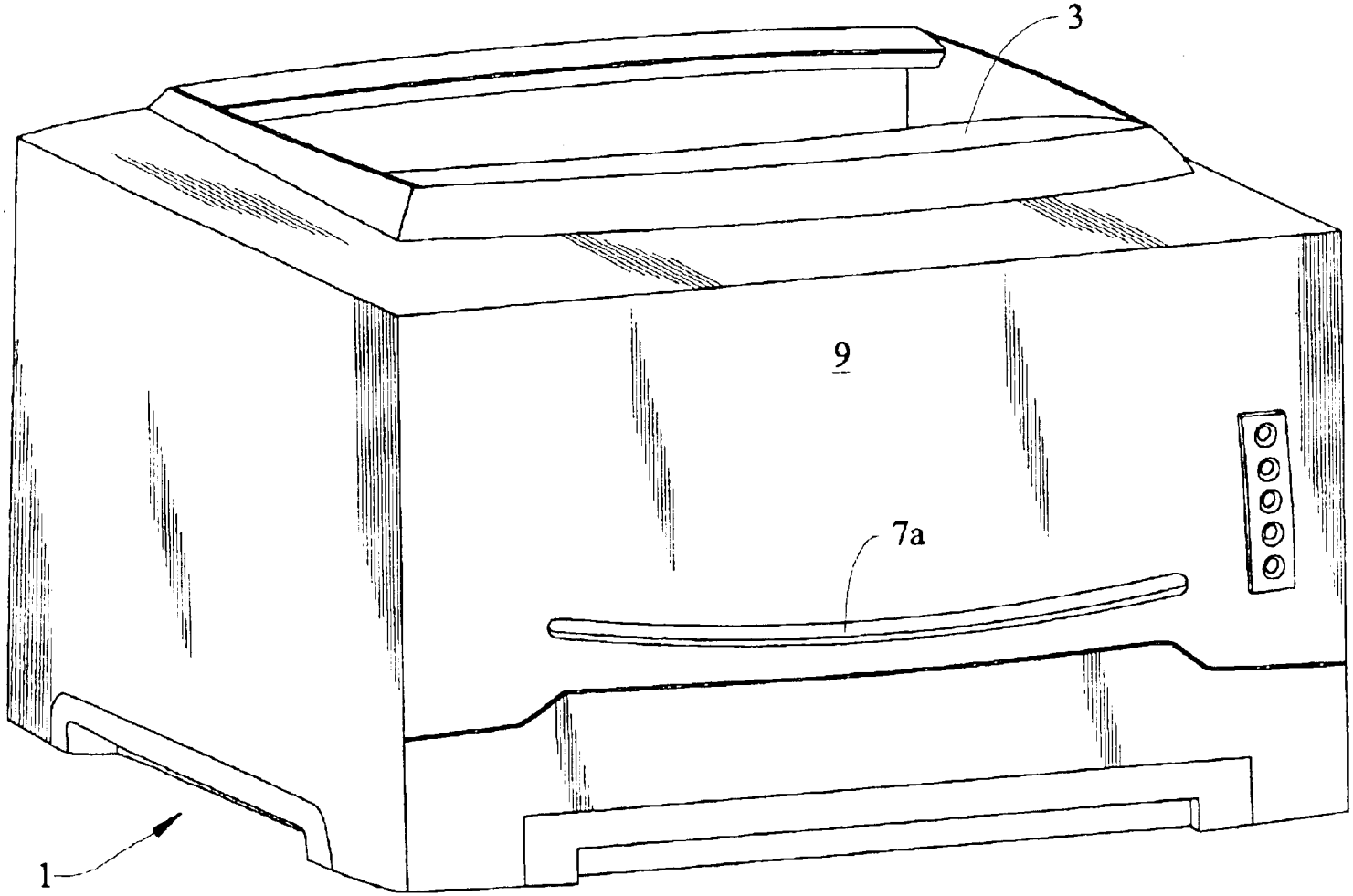
FIG. 5 is illustrative of an alternative embodiment in which the slot itself is bent.

A wide variety of configurations could provide the bowed configuration by which this invention functions. One alternative is shown in FIG. 5. Slot 7*a* is an open slot leading directly to sheet feed mechanism as is slot 7. However, slot 7*a* is in the form of a bow and has no guide on each side. Slot 7*a* should be of sufficient height to permit relatively easy insertion, but a disadvantage is that is must be sufficiently narrow in height so as to not allow flat insertion of the paper in slot 7*a*.

Accordingly, a wide variety of implementations are anticipated, as is intended to be understood with respect to the accompanying claims.

What is claimed is:

1. An imaging device comprising a sheet feed for feeding sheets to be imaged;

an entrance slot in a non-horizontal side of said imaging device for receiving a sheet to be imaged from outside of said imaging device, said entrance slot having a width dimension and a height dimension, said width dimension being somewhat greater than a width of said sheet, said height dimension being much greater than a thickness of said sheet;

an entrance guide in a said non-horizontal side of said imaging device for moving a sheet to be imaged from outside of said imaging device into said sheet feed, wherein said entrance guide comprises a pair of curved guide structures positioned on opposite sides of said entrance slot, and positioned such that the pair of curved guide structures are spaced-apart from one another, so as to allow said sheet to pass therebetween;

said entrance guide being configured to permit said sheet to move to said sheet feed only when said sheet is bowed as viewed along the sheet's direction of travel, wherein said pair of curved guide structures each have an upper protruding member that curves toward a middle portion of said entrance slot, so as to contact a top surface of said sheet, thus forcing said sheet to bow downward in a direction toward a middle portion of said sheet, and thereby impart the bowed shape in said sheet.

2. The imaging device as in claim 1, wherein each of said guide structures has a lower protruding member having a lower surface sloped upward with respect to the lower side of said slot and wherein said upper protruding member has an upper surface sloped downward to reach a location below the uppermost elevation of said lower surface, wherein said lower surface on each said guide structure forces the sides of said sheet upward with respect to the middle of said sheet.

3. The imaging device as in claim 2 in which said guide structures are movable to change the amount of separation of said guide structures to thereby receive paper of different widths.

4. The imaging device as in claim 2 also comprising at least one visually apparent blocking element depending near the center of said slot to at least appear to block said paper from passing through said slot while horizontal.

5. The imaging device as in claim 3 also comprising at least one visually apparent blocking element depending near the center of said slot to at least appear to block said paper from passing through said slot while horizontal.

6. A printer device comprising a sheet feed for feeding sheets to be printed;

an entrance slot in a non-horizontal side of said printing device for receiving a sheet to be printed from outside of said printing device, said entrance slot having a width dimension and a height dimension;

an entrance guide in said non-horizontal side of said printing device for moving a sheet to be printed from outside of said printing device into said sheet feed, wherein said entrance guide comprises a pair of curved guide structures positioned on opposite sides of said entrance slot, and positioned such that the pair of curved guide structures are spaced-apart from one another, so as to allow said sheet to pass therebetween;

said entrance guide being configured to permit a said sheet to move to said sheet feed only when said sheet is bowed, wherein said pair of curved guide structures each have an upper protruding member that curves toward a middle portion of said entrance slot, so as to contact a top surface of said sheet, thus forcing said sheet to bow downward in a direction toward a middle portion of said sheet, and thereby impart the bowed shape in said sheet.

7. The printer as in claim 6, wherein each of said guide structures has a lower protruding member having a lower surface sloped upward with respect to the lower side of said slot and wherein said upper protruding member has an upper surface sloped downward to reach a location below the uppermost elevation of said lower surface, wherein said lower surface on each said guide structure forces the sides of said sheet upward with respect to the middle of said sheet.

8. The printer as in claim 7 in which said guide structures are movable to change the amount of separation of said guide structures to thereby receive paper of different widths.

9. The printer as in claim 7 also comprising at least one visually apparent blocking element depending near the center of said slot to at least appear to block said paper from passing through said slot while horizontal.

10. The printer as in claim 8 also comprising at least one visually apparent blocking element depending near the center of said slot to at least appear to block said paper from passing through said slot while horizontal.

11. A manual sheet guiding device used in a printing apparatus, said sheet guiding device comprising:

an enclosure of a printing apparatus, said enclosure having at least one side wall having a non-horizontal exterior surface;

a longitudinal opening in said at least one side wall, said opening having a first end and a second end at opposite portions of said longitudinal opening, and said opening being configured to receive a sheet of print media being manually fed from a position exterior to said printing apparatus;

a first entrance guide located proximal to said first end of the longitudinal opening, and a second entrance guide located proximal to said second end of the longitudinal opening;

said first and second entrance guides being spaced-apart from one another, and positioned to contact a portion of said sheet of print media and to thereby impart a bowed shape into said sheet of print media as said sheer of print media passes into and through said longitudinal opening; and said first and second entrance guides each having a lower curved protruding member, an upper curved protruding member, and an outermost side member, in which said lower curved protruding member is sized and positioned to contact a portion of a bottom surface of said sheet of print media, said outermost side member is sized and positioned to limit a lateral movement of said sheet of print media, and said upper curved protruding member is sized and positioned, by curving in a direction from said outermost side member toward a center portion of the sheet of print media, so as to contact a top surface of said sheet of print media and to force said sheet of print media to bow downward toward a center portion of said sheet of print media.

12. The sheet feeder device as recited in claim 11 wherein, when said sheet of print media exhibits a bowed shape due to contact with said first and second entrance guides, said sheet is substantially prevented from sagging when it is being introduced into said longitudinal opening, even when said sheet is oriented in a substantially horizontal manner, without any exterior paper tray that would otherwise provide additional support for said sheet.

13. The sheet feeder device as recited in claim 11, further comprising: at least one visually apparent blocking element which extends substantially downward from an upper surface of said longitudinal opening in said at least one side wall at a position near a center portion along said longitudinal opening.

14. The sheet feeder device as recited in claim 13, wherein said at least one visually apparent blocking element requires said sheet of print media to bow downward in its middle portion, in order to pass into and through said longitudinal opening.

15. The sheet feeder device as recited in claim 11, wherein said longitudinal opening runs substantially horizontal when said printing apparatus is placed upon a substantially horizontal surface.

16. The sheet feeder device as recited in claim 11, wherein said first and second entrance guides are movable to change the amount of separation between said first and second entrance guides, to thereby receive sheets of print media exhibiting different widths.

17. The sheet feeder device as recited in claim 11, wherein there is no structure in a center portion of said longitudinal opening that blocks any portion of said sheet of print media.

* * * * *